US005168544A

United States Patent [19]

Kolasa

[11] Patent Number: 5,168,544

[45] Date of Patent: Dec. 1, 1992

[54] METHOD AND APPARATUS FOR CONTROLLABLY GENERATING SIMULATED SMOKE

[75] Inventor: Emily E. Kolasa, White Hall, Md.

[73] Assignee: AAI Corporation, Cockeysville, Md.

[21] Appl. No.: 707,868

[22] Filed: May 31, 1991

[51] Int. Cl.[5] ..... F22B 1/04

[52] U.S. Cl. ..... 392/396; 392/387; 392/399

[58] Field of Search ..... 392/394, 396, 399, 402, 392/403, 405, 387

[56] References Cited

U.S. PATENT DOCUMENTS

| | | | |
|---|---|---|---|
| 2,510,235 | 6/1950 | Kogel | 392/394 |
| 2,662,332 | 12/1953 | McIntire | 392/399 |
| 2,920,179 | 1/1960 | Shaw | 392/394 |
| 3,025,533 | 3/1962 | Hair | 392/399 |
| 3,406,097 | 10/1968 | Port | 392/399 |
| 3,565,051 | 2/1971 | Swift | 126/595 |
| 3,969,996 | 7/1976 | Huang | 99/476 |
| 4,349,723 | 9/1982 | Swiatosz | 392/399 |
| 4,414,037 | 11/1983 | Friedheim | 392/399 |
| 4,578,563 | 3/1986 | Eguchi | 392/396 |
| 4,732,085 | 3/1988 | Gershenson | 102/334 |

*Primary Examiner*—Teresa J. Walberg

*Attorney, Agent, or Firm*—Griffin, Butler, Whisenhunt & Kurtossy

[57] ABSTRACT

An apparatus and method for controllably generating simulated smoke from a simulated smoke-generating fluid which has a vaporizing chamber with an inlet, an outlet, and walls extending therebetween so as to substantially enclose the chamber and define a chamber cross section which is substantially the same as an annular space between the walls. The chamber has a center line between an inlet wall and an outlet wall such that the center line is declined from the horizontal from the inlet wall to the outlet wall. A lower surface in the chamber is substantially co-extensive with a major portion of inside surfaces of lowermost portions of the walls and terminates at one end thereof near the inlet in a surface terminus of defined width. Smoke fluid is distributed along the terminus so that the smoke fluid is flowable by gravity downwardly across the surface as a thin film. Heaters and heater controls are used to control the heating of the chamber and the surface to a temperature sufficient to cause the smoke fluid to vaporize into a vapor. An ejector ejects the vapor out of the chamber through the outlet into a mixer which communicates with heated air for mixing the vapor and heated air and producing the simulated smoke.

47 Claims, 4 Drawing Sheets

FIG. 3
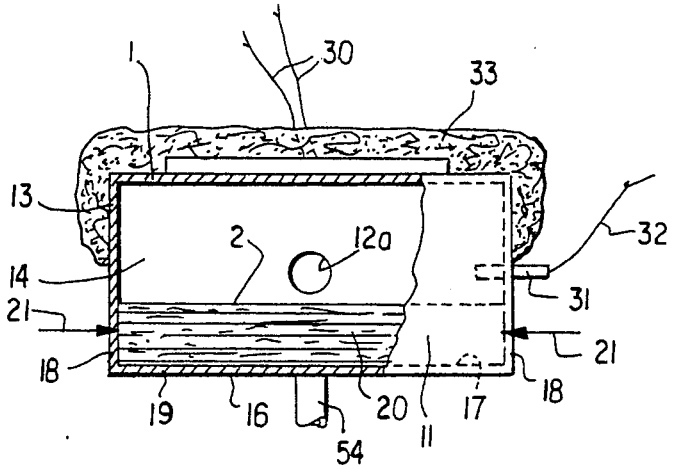
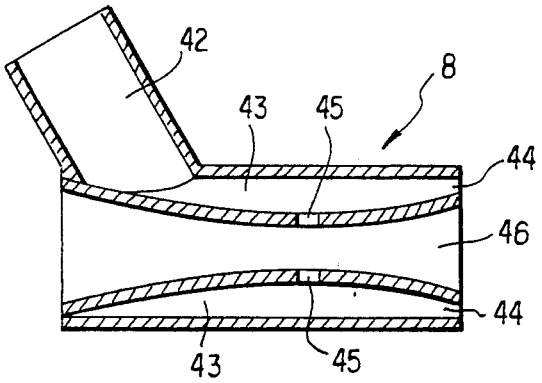
FIG. 4
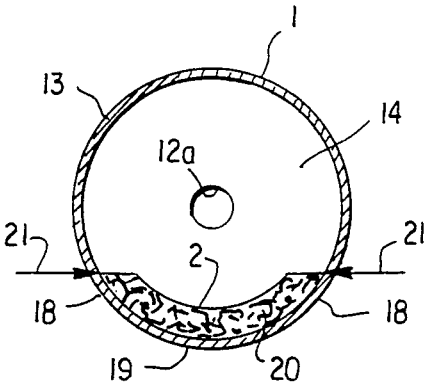
FIG. 5
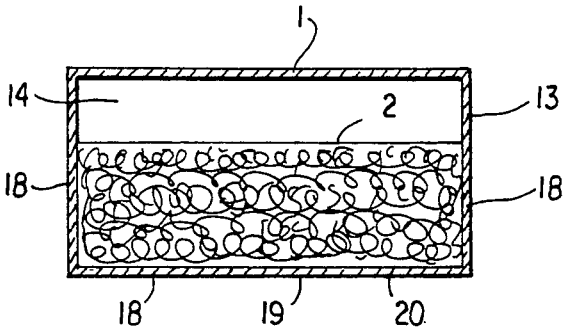
FIG. 6

FIG. 7
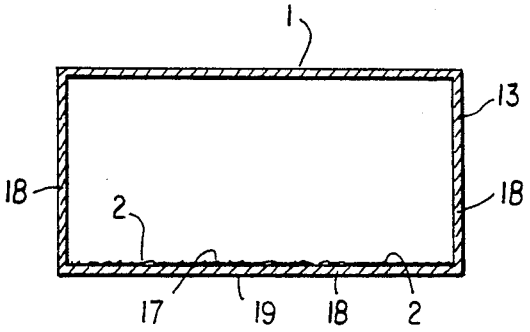
FIG. 8
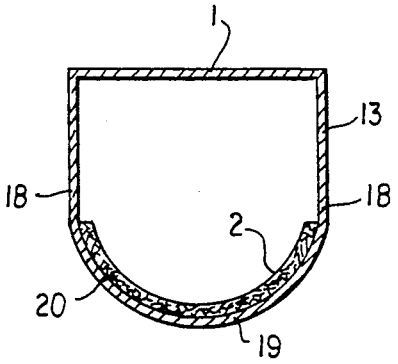
FIG. 9
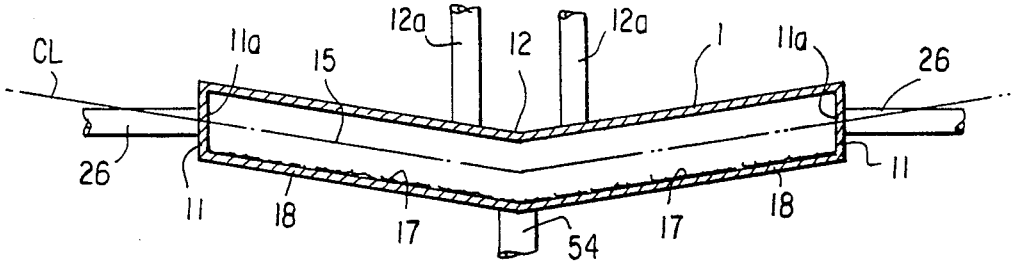
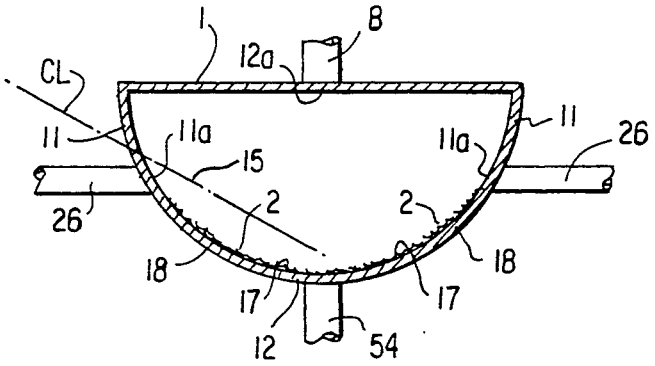
FIG. 10

METHOD AND APPARATUS FOR CONTROLLABLY GENERATING SIMULATED SMOKE

The present invention relates to methods and apparatus for controllably generating simulated smoke, and especially such smoke generated from conventional smoke-generating fluids, such as hydrocarbon or substituted hydrocarbon smoke-generating fluids.

BACKGROUND OF THE INVENTION

Simulated smoke is generated for a number of applications, including military screening of areas, theatrical effects, and training of fire fighters, among others. The present invention relates to these usual applications for simulated smoke generation, but it is particularly applicable to those applications where the generation of the simulated smoke must be closely controlled. As an example thereof, when simulated smoke is used for training fire fighters, the training environment is arranged such that when the trainee properly applies the correct extinguishing agent, at the correct position of a simulated fire and for the correct length of time, the simulated fire is extinguished, and the simulated smoke associated therewith is likewise extinguished. On the other hand, for example, if the trainee does not apply the extinguishing agent for the correct length of time, even though the simulated fire and smoke are discontinued, a "flashback" or "burnback" of sudden reignition is simulated by an immediate burst of simulated fire and smoke. Thus, as opposed to other applications, such as theatrical applications, where the commencement and discontinuance of the smoke in very short periods of time is not necessary, for purposes of training fire fighters, such commencement and discontinuance in a very short period of time is most desirable, in order to realistically represent actual fire conditions for the trainee.

Simulated smoke generation is usually achieved by vaporizing a smoke-generating fluid and mixing that vaporized fluid with air such that an aerosol fog of the vaporized and at least partially condensed smoke-generating fluid is produced. As can be appreciated, therefore, in order to generate such a simulated smoke from a smoke-generating fluid, the apparatus and methods utilized must heat the smoke fluid to a temperature sufficient to cause substantial vaporization thereof and, at the same time, mix the vaporized smoke fluid with air to provide the aerosol fog of the vaporized and condensed smoke fluid. However, as can also be appreciated, heating the smoke fluid to temperatures sufficient to cause substantial vaporization for smoke-generating purposes and then cooling that fluid to temperatures such that substantial generation of vapor and smoke does not occur, in a very short period of time, poses a considerable difficulty in the art.

Basically, in the prior art, simulated smoke has been produced in one of several manners. First, a hot gas, usually air, is passed in contact with smoke fluid, which may be in either a heated or unheated condition. The hot air causes vaporization of the smoke fluid into the air, and, with cooling, the desired fog results. However, as can be appreciated, if the hot air is used to heat the smoke fluid, a considerable time lapse is required for enough hot air to pass in contact with the smoke fluid to cause sufficient heating of the fluid and generation of vapors therefrom. Therefore, there is a slow and gradual buildup of vaporized smoke fluid in the hot air, and, as a result, there is, correspondingly, a slow and gradual buildup of the fog so produced. This, of course, would be most unsatisfactory for fire fighter trainees, since this would not duplicate actual fire fighting experiences.

Another method is that of heating a pool of smoke fluid to a temperature sufficient that substantial vapors therefrom are produced, and then blowing air, heated or unheated, over the fluid to cause the desired fog of simulating smoke. However, as can be appreciated, in this method, again, during the time period required to sufficiently heat the pool of smoke fluid and the time period required for cooling the pool of smoke fluid, the density of the fog produced will slowly increase and then slowly decrease, respectively, which, again, is not a realistic representation of actual fire fighting conditions.

Another method in the art is that of atomizing the smoke fluid and forming an aerosol thereof directly in the forced air, which may or may not be heated. However, the fog produced by this method, being relatively cold, has a density greater than air, and rather than the fog rising, for example in a room, so as to simulate the actual effect of smoke, the fog settles toward the floor of that room and gives the appearance of a theatrical effect, rather than a fire effect. This, of course, is totally unacceptable for training fire fighters.

Another method in the art admixes steam with the smoke fluid to produce vapors thereof, and then forces that mixture through narrow orifices into the atmosphere where the steam and vapor are chilled to produce a fog. Here again, the rising effect of smoke in actual fires is not duplicated.

Conventional smoke bombs have also been used for this purpose, but they are not controllable, since once the bomb is exploded, it continues to produce smoke, unabated, until the smoke fluid is depleted.

Representative of the above briefly discussed prior art are U.S. Pat. Nos. 4,439,341; 4,547,656; 4,568,820; 4,764,660; and 4,818,843.

Recently, it has been proposed in the art to provide a vaporizing unit for the smoke fluid where the smoke fluid passes between interior walls of a vaporizing chamber and exterior walls of a vaporizing element, where the passageway therebetween is narrow and produces a very high surface area/volume ratio. By this means, smoke fluid can be rapidly heated to produce vapors thereof, and then those vapors are expelled into the atmosphere for producing the desired fog (see U.S. Pat. No. 4,871,115). However, this apparatus has several distinct disadvantages. Firstly, there is a considerable thermal lag in heating and cooling the apparatus, with a corresponding lag in the commencement and discontinuance of smoke. Secondly, the narrow passage between the interior walls of the chamber and the exterior walls of the vaporizing element can be clogged by residues and thermal degradation products of the smoke fluid when heated to vaporization temperatures. This cause unevenness and discontinuities in the vapors produced and, hence, in the fog produced. Further, the fog is produced by passing the heated vapors to ambient air, for cooling and fogging purposes, and that fog, of course, as explained above, will be more dense than air and will, therefore, settle. This device is, therefore, very useful for producing theatrical effects, but is not particularly useful for fire fighter training.

It would, therefore, be of substantial advantage in the art to provide an apparatus and method for controllably generating simulated smoke, where that simulated smoke has the same rising characteristics as actual smoke and where that simulated smoke can be quickly commenced and quickly discontinued. It would be a further advantage in the art to provide for such smoke generation by use of relatively modern smoke fluids which have less toxicity and less potential for ignition than older smoke-generating fluids.

BRIEF DESCRIPTION OF THE INVENTION

The invention is based on four primary discoveries and several secondary discoveries. Firstly, as a primary discovery in this regard, it was discovered that quickly commencing and quickly discontinuing the generation of smoke from a pool of smoke fluid was most difficult, if not impossible, when such commencement and discontinuance are based on heating and cooling the pool of smoke fluid to or below significant vaporization temperatures. Thus, it was discovered that in order to provide fast commencement and fast discontinuance of smoke generation, it is necessary to commence and discontinue withdrawing already vaporized smoke fluid from a supply thereof in a chamber therefor so that the commencement and discontinuance of smoke generation can be quickly achieved. Thus, preferably, the chamber will have a cross-section which is substantially the same, or largely the same, as the annular space between chamber walls, and in any event sufficient so as to provide space for storage of the smoke vapor.

As a second primary discovery, it was found that in order to quickly vaporize smoke fluid for quickly providing additional vapor to the supply thereof, there must be a considerable surface area of the smoke fluid so that quick vaporization may take place. It was further found that this large surface area of the smoke fluid must be in the form of a thin film of the smoke fluid.

As a secondary discovery, it was also found that a thin film of smoke fluid, which provides very substantial surface area per unit volume for vaporization of the smoke fluid, is best provided, in many applications, by an expanded surface on which the smoke fluid flows for vaporization purposes. As a further secondary discovery, it was found that the expanded surface area for such applications should be about twice the surface area per unit as non-expanded surfaces.

As a third primary discovery, it was found that the thin film of smoke fluid should be flowed by gravity and in the absence of other pressure flow means, so as to ensure reliable operation of the smoke generation. Thus, the surface on which the smoke fluid flows must have a slope.

As a fourth primary discovery, it was found that in order to produce an acceptable smoke, with required rising characteristics for fire fighting training, the generated vapor must be mixed with heated air in order to not only cause formation of the simulated smoke aerosol fog, but to keep that simulated smoke at a density so that it will rise in air, in the manner of natural smoke.

As a secondary discovery in this regard, it was found that the best means of achieving such mixture, is that of introducing heated air into the chamber or withdrawing vaporized smoke fluid from a supply thereof in the chamber. In either case, the amount of vaporized smoke fluid is responsive to the amount of heated air to be mixed with the vaporized smoke fluid. This ensures that a correct mixture of the vaporized smoke fluid and heated air is achieved, so as to produce the required fog, while at the same time producing that fog of a density so that it will rise in air.

Thus, briefly stated, the present invention provides an apparatus for controllably generating simulated smoke from a simulating smoke-generating fluid. The apparatus comprises a vaporizing chamber having an at least one inlet, at least one outlet and walls extending between the inlet and outlet so as to substantially enclose the chamber. Preferably, the walls define a chamber with a cross section which is substantially the same as an annular space between the walls so as to provide a chamber sufficient both for vaporization of the smoke fluid and for containing a supply of the generated vapor which can be withdrawn, on demand, for commencing smoke generation. That chamber has a center line (or series of center lines) between an inlet wall and an outlet wall such that the center line is declined to the horizontal from the inlet wall to the outlet wall. This provides a slope of the chamber, and when smoke fluid is introduced into the chamber at the inlet, that slope will allow the smoke fluid to flow down a bottom wall or walls of the chamber by gravity. It has been found that gravity provides the best means of moving smoke fluid in a thin film for vaporization purposes, bearing in mind the reliability of the equipment, avoiding difficulties of residues, providing high surface area of a thin film of smoke fluid, and the like.

In order to provide the high surface area for vaporization of the smoke fluid, preferably, an expanded surface is disposed on and is substantially coextensive with a major portion of inside surfaces of lowermost portions of a side wall or walls (which may include a bottom wall or walls). The surface, whether expanded or not, terminates near one end near the inlet in a terminus of defined width.

A smoke fluid distribution means is provided for distributing smoke fluid along that terminus and that width so that the smoke fluid is flowable by gravity from the terminus, downwardly across the surface (expanded or not), and toward the outlet, as a thin film of the smoke fluid. That thin film, in view of the smoke fluid being distributed across the width thereof, will have a high surface area per unit volume for quick vaporization of the smoke fluid.

A smoke fluid supply is provided for containing the smoke fluid, and a conduit communicates with that supply to the distribution means so that the smoke fluid may be flowed from the supply to the distribution means. A flow control means is provided for controlling the flow of the smoke fluid to the distribution means. Thereby, the amount of vaporized smoke fluid vaporized in the chamber can be controlled directly by that flow control means.

Heating means and heating control means are provided for controllably heating the chamber and the surface to a temperature sufficient to cause the smoke fluid in the thin film to vaporize into a smoke fluid vapor. That vapor is contained in the chamber, and the chamber functions as the supply of the smoke fluid vapor.

An ejector means, e.g. a blower or venturi, is provided for ejecting the smoke fluid vapor from the chamber through, usually, an outlet wall of the chamber. A heated air supply means is provided for supplying air heated at a temperature sufficient to retain the smoke fluid vapor (when mixed with the heated air and, thus, at least partially condensed) at a density lighter than air. This causes, of course, the so-generated simulated smoke (fog) to rise in air, in the manner of real smoke.

To achieve that effect of the simulated smoke, a mixing means communicates with the ejector and the heated air means for mixing the smoke fluid vapor and the heated air such that the correct fog is produced. The mixing means may be the chamber itself or a separate device.

Also, there is a heated air control means for controlling the flow of heated air to the mixing means, such that the correct proportions of heated air and smoke fluid vapor are mixed in the mixing means.

Similarly, in connection with the present method, the invention provides a method for controllably generating simulated smoke from a simulating smoke-generating fluid. The method comprises providing an vaporizing chamber having an inlet, an outlet, and walls extending between the inlet and outlet so as to substantially enclose the chamber. Preferably, the walls provide a chamber with a cross section which is substantially the same as an annular space between the walls. The chamber has a center line between an inlet wall and an outlet wall such that the center line is declined to the horizontal from the inlet wall to the outlet wall.

Preferably, an expanded surface is provided and disposed on, and substantially co-extensive with, a major portion of the inside surfaces of lowermost portions of side walls of the chamber (which may include a bottom wall or walls). However, that surface, whether expanded or not, terminates at one end near the inlet in a terminus of defined width.

Smoke fluid is distributed along the terminus and flows from the terminus downwardly by gravity across the surface (expanded or not) and toward the outlet as a thin film of smoke fluid. The chamber is then controllably heated, along with the surface, to a temperature sufficient to cause the smoke fluid in the thin film to vaporize to a smoke fluid vapor. The smoke fluid vapor is ejected from the chamber, e.g. by a blower or venturi, and, usually, through an outlet wall and into a mixer or the chamber itself may serve as the mixer. Heated air is supplied at a temperature sufficient to retain the smoke fluid vapor lighter than air when mixed with the heated air (and, hence, at least partially condensed). The smoke fluid vapor and the heated air are then mixed in a separate mixer or the chamber to produce the simulated smoke. However, the amount and density of the simulated smoke is controlled by the amount of smoke fluid distributed to the terminus, the temperature of the chamber, and the amount of heated air supplied to the mixer or chamber.

BRIEF DESCRIPTION OF THE DRAWINGS

FIG. 3 is an end view of the chamber of FIG. 1 taken along the lines II—II.

FIG. 4 is a cross-sectional side view of an ejector suitable for use in the present invention.

FIGS. 5, 6, 7, 8, 9 and 10 are alternative geometric configurations of the chamber and are shown in cross section.

FIG. 11 is a cross-sectional view of FIG. 12 along lines III—III.

DETAILED DESCRIPTION OF THE INVENTION

Figure 1:
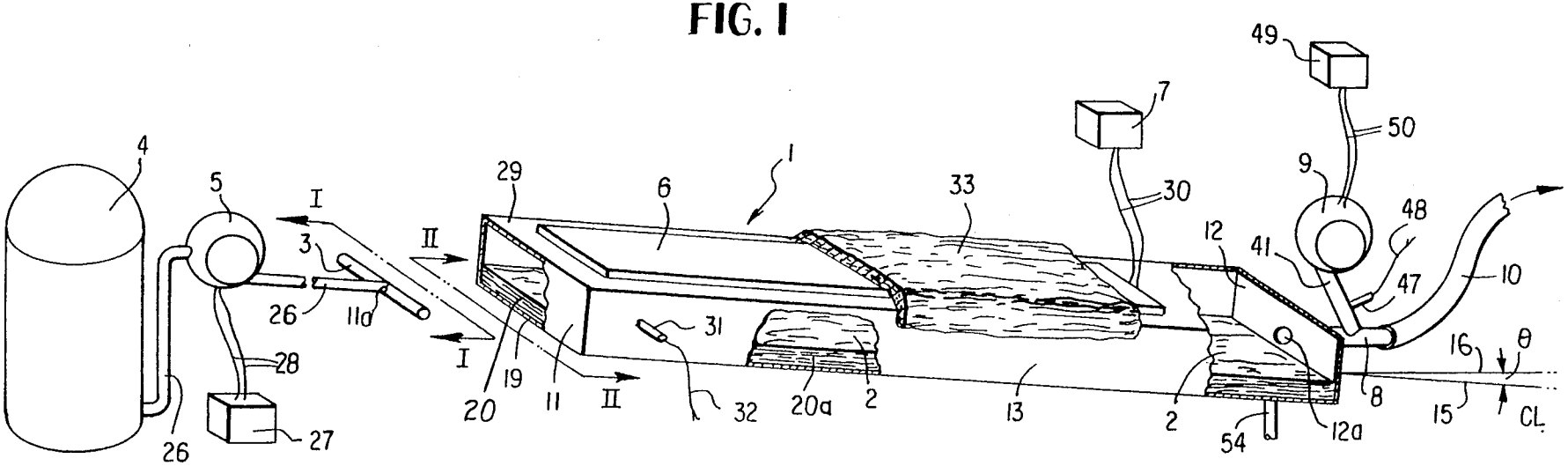
FIG. 1 is a schematic diagram of a preferred embodiment of the present apparatus, isometrically shown and in partial cross section.

FIG. 1 is a diagrammatic illustration of the major components of an embodiment of the present apparatus. As shown in FIG. 1, the major components comprise a vaporizing chamber 1, an expanded surface 2, a smoke fluid distribution means 3, a smoke fluid supply means 4, a smoke fluid flow control means 5, a heating means 6, a heating control means 7 for heating the chamber and expanded surface, an ejector means 8, a heated air supply means 9, and a mixing means 10.

As shown in FIG. 1, the vaporizing chamber 1, in this embodiment, is an elongated chamber and has an inlet wall 11 with an inlet 11*a*, an outlet wall 12 with an outlet 12*a*, and side walls 13 extending between the inlet wall 11 and outlet wall 12 so as to substantially enclose the chamber. Further, these walls define a chamber cross section (see FIG. 3) which is substantially the same as an annular space between the walls.

As seen in FIG. 1, the chamber 1 has a center line 15 between the inlet wall 11 and outlet wall such that the center line is declined at an angle Θ to the horizontal (line 16) from the inlet wall 11 to the outlet wall 12.

The expanded surface 2 is disposed on and is substantially co-extensive with a major portion of inside surfaces 17 (see FIG. 3) of lowermost portions 18 of the side walls 13 (including the bottom wall o walls 19). As can be appreciated, the expanded surface 2 could be totally co-extensive with the lowermost portions 18 or could be substantially less than co-extensive with lowermost portions 18. For example, the chamber 1 could be relatively long or wide so that the lowermost portions 18 with expanded surface 2 could adequately vaporize sufficient smoke fluid in only a relatively small portion of that chamber, with the remainder of the chamber (that portion not having the expanded surface 2) simply serving as a reservoir for containing a supply of vaporized smoke fluid. However, it has been found that, usually, there is no necessity for such increased storage capacity of vaporized smoke fluid, since with the present apparatus the smoke fluid can be very quickly vaporized, on demand. Therefore, usually, the expanded surface will be substantially co-extensive with a major portion (at least 50%, more usually at least 60%, and most often at least 80%) of the inside surfaces 17 of lowermost portions 18.

Somewhat similarly, it is not normally necessary to have a substantial thickness of the expanded surface and, therefore, the major portion of the chamber will simply be a reservoir for storage of vaporized smoke fluid. For example, FIG. 3 shows that the expanded surface occupies about one third of the cross section of the chamber, while FIG. 6 shows that the expanded surface occupies approximately two thirds of the cross section of the chamber. However, for most purposes, a relatively thin expanded surface will more than adequately present a high surface area for the thin film flowed down the expanded surface, and the expanded surface is only a small portion of the cross section of the chamber, e.g. only about 15%, as shown in FIG. 5, or even only about 8%, as shown in FIG. 8 or 4% as shown in FIG. 10. Indeed, for many smoke generation purposes, the percent of cross section of the chamber occupied by expanded surface 2 can be quite low, such as shown in FIG. 7, i.e. only about 1% or 2%. For some applications, an expanded surface is not required at all (although this usually results in a large chamber size)

and the inside surface 17 is not expanded as shown in FIG. 9, and as explained in more detail below.

In part, the percentage of the cross section of the chamber occupied by the expanded surface will depend upon the particular expanded surface chosen. Preferably, the expanded surface will have a surface area per unit (per square inch, per square centimeter, etc.) which is at least twice the surface area per same unit as the inside surface 17 not having the expanded surface disposed thereon. More preferably, however, the expanded surface will have at least three times, and even more preferably at least five times and up to thirty times more surface area per unit.

When sufficient smoke can be vaporized, for the purposes intended, with only, for example, twice the increase in surface area per unit, such an expanded surface can be provided simply by roughening the inside surface 17 of lowermost portion 18 of chamber 1, as shown in FIG. 7. This can be by corrugations, deep scratches, grooves, etching, high-intensity sandblasting, and the like. However, where the amount of smoke fluid which must be vaporized is of a greater amount, normally, the expanded surface is in the form of an insert which is disposed on the inside surfaces 17. That insert may be mechanically held to those inside surfaces in any manner desired, e.g. mechanically attached with convenient fasteners. Such an insert can take many different forms, and it is only necessary to achieve the increase in surface area per unit, as explained above. However, typically, the insert will be comprised of expanded sheets, e.g. sheets of metal, which are made in known techniques by cutting and pulling the sheets to expand the surfaces. A plurality of such sheets may be stacked upon one another for providing an insert of the desired thickness for achieving the desired increase in surface area per unit. Alternatively, the insert may be an expanded mesh, e.g. a metal mesh, such as the metal meshes used for providing filters, and the like, in high temperature applications. The expanded mesh is quite efficient in expanding the surface area per unit, and FIG. 8 shows such an expanded mesh, with that expanded mesh occupying only a small portion of the cross section of the chamber. On the other hand, where, for example, expanded sheets are used, any desired thickness of those sheets can easily be achieved by applying one sheet above the other as a plurality of sheets in a stack, such as shown in FIG. 3.

However, the insert need not be sheets or mesh at all, but may be a metal filtering material, such as steel wool, as shown in FIG. 6, or may be distillation packing rings, such as whole or parts of Berrell saddles and the like, as shown in FIG. 5.

The particular expanded surface is not critical, so long as the expanded surface can withstand the temperatures of the vaporization chamber, provide the required increased surface area per unit for forming the thin film and for fast vaporization of the smoke fluid, and is relatively easily replaced or cleaned for removing any residue of the vaporized smoke fluid. Thus, the expanded surface, as noted above, may be simply a roughened lowermost surface of the chamber or in the form of an insert, e.g. made of metal or ceramic, and may take any desired form, so long as the above criteria are met.

As shown in FIG. 1, the expanded surface 2 terminates near one end and near inlet wall 11 in an expanded surface terminus 20. That terminus 20 is an extension of the surface material **20*a* and has a defined width, as shown by arrows 21 in FIGS. 3 and 5**.

Figure 2:
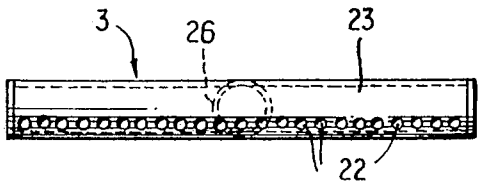
FIG. 2 is an end view of the distributor taken along the line I—I.

The smoke fluid distribution means 3 will have a configuration approximating the configuration of the terminus 20, e.g. distribution means 3 in FIG. 2 approximates the configuration of terminus 20 in FIG. 3. This allows the distribution means 3 to distribute the smoke fluid along the terminus 20 and along the defined width 21 of expanded surface 2. By this arrangement, the smoke fluid is flowable by gravity from the terminus 20, downwardly across the expanded surface 2 of material **20*a* and toward the outlet wall 12** as a thin film of smoke fluid. In this regard, the term "thin film" means an average film thickness of no more than ⅛ inch thick, preferably no more than 1/16 inch thick. Ideally, the film will be as thin as possible and yet be able to flow, by gravity, through the chamber. Thus, for some smoke liquids of low viscosity, the film thickness can be as low as 0.010 inch.

To achieve that flow by gravity as a thin film, center line 15 (see FIG. 1) is declined to the horizontal 16. In the example shown in FIG. 1, the chamber cross section is rectangular, and the center line extends between the inlet wall 11 and the outlet wall 12. Therefore, in this case, the center line is straight, although this is not necessary. For example, the chamber may be in an arcuate configuration, such as shown in FIG. 10, so that there are a plurality of center lines, and it is only necessary that the plurality of center lines, together, decline to the horizontal from the inlet wall to the outlet wall, as shown in FIG. 10, in order to allow the smoke fluid to flow by gravity through the chamber. However, in the example shown in FIG. 1, as well as other arrangements such as arcuate arrangements of the chamber shown in FIG. 10, the overall center line is declined from the horizontal in an amount of between 5° and 30°, more preferably an amount between 10° and 20°. For most conventional smoke fluids, and especially for the newer lower toxic, lower burnable fluids, this decline from the horizontal will allow the smoke fluid to flow across the expanded surface, present great surface area for vaporization of the smoke fluid, and allow that flow to be by gravity.

Turning again to the details of distribution means 3, as shown in FIG. 2, that distribution means may have a series of orifices 22 for distributing the smoke fluid, although the particular openings for flowing the smoke fluid to the terminus 20 is not critical and may simply be a slot or a weir or any other like distribution means. While FIG. 1 shows, for clarity purposes, an exploded view of the apparatus where distribution means 3 is spaced from the terminus 20, in construction of the apparatus, the distribution means will abut or be very near to terminus 20. That distribution means, however, should distribute the smoke fluid in a relatively uniform manner across width 21 (see FIG. 3) and in a flow rate such as to provide the commencement of a thin film flow of the smoke fluid.

As shown in FIG. 1, there is a smoke fluid supply means 4 for containing the smoke fluid, and this may be any suitable container. A conduit means 26, e.g. pipe, tubing or the like, communicates with the supply means 4 and the inlet **11*a* of distribution means 3 for flowing the smoke fluid from the supply means 4 to the distribution means 3. Flow control means 5 controls the flow of smoke fluid to the distribution means, and that flow control means 5 may be, for example, a pump, preferably a variable flow pump, the starting and stopping of which and the rate of pumping of which are controlled by pump controller 27 through electrical lines 28. By controlling the starting and stopping of the pump, the smoke fluid delivered to distribution means 3 can be uniformly supplied through an elongated passageway 23 in distribution means 3 and through a plurality of orifices therein disposed along the terminus, as shown in FIG. 2**.

In order to vaporize the smoke fluid, a heating means 6 is used in connection with chamber 1. While the heating means may be of types and dispositions on chamber 1 as desired, quite conveniently, the heating means 6 is one or a plurality of strip heaters (only one being shown in FIG. 1) disposed along an outside wall 29 or all of the outside walls 29 of chamber 1. However, if desired, resistant wire heaters or hot air enveloping heaters, super saturated steam chambers, propane heaters, and the like, may be used for heating the chamber. However, the heating of the chamber is most conveniently carried out by electric heaters disposed along the outside surface of the outer walls 29, with preferably at least one heating means on the bottom wall, and a heat control means 7 controls the temperature of the chamber by supplying current, as required, through electrical lead lines 30. That current is usefully controlled by a thermosensor 31, e.g. a thermocouple, for sensing the temperature in the chamber and applying or discontinuing electric current to electric heaters 6. Thermosensor 31 is connected by lead line 32 to a controller (not shown). Typically, the electric heaters and the chamber will be covered by insulation 33 for heat conservation and uniformity of heat purposes.

The heating means, along with the heating control means, controllably heats the chamber and the expanded surface to a temperature sufficient to cause the smoke fluid in the thin film to adequately vaporize to a smoke fluid vapor. The particular temperature to which the chamber and expanded surface are heated will depend upon the particular smoke fluid being utilized. However, modern smoke fluids require a temperature of at least about 400° F., and up to 1000° F. So that the apparatus may handle any of the modern smoke fluids, the heaters and controllers should be capable of heating and controlling the chamber to at least within that temperature range.

The ejector means 8 communicates with chamber 1 through outlet 12*a* (see FIGS. 1 and 3) and, therefore, may eject vaporized smoke fluid from chamber 1, on demand. Thus, the ejector is a means for ejecting the smoke fluid vapor out of chamber 1 and through the outlet 12*a* of wall 12, and the ejector may be any device desired, so long as it can controllably move smoke fluid vapor out of the chamber. Such a device, for example, could be a pump or fan or blower or the like, as explained more fully below, but conveniently for most applications, the ejector is a conventional venturi ejector, as shown in FIG. 4. In such conventional venturi ejectors, hot air supplied by heated air supply means 9 is passed through a conduit 41 (see FIG. 1) and into a venturi inlet 42 through venturi chamber 43 and out of venturi outlet 44. One or more venturi orifices 45 communicate with delivery chamber 46, and by the flow of the hot air through venturi chamber 43, negative pressure is caused in delivery chamber 46, which negative pressure will draw smoke fluid vapor from chamber 1 through outlet 12*a* and into ejector 8 in response to the flow of hot air from heated air supply means 9. The venturi may be sized so that for any particular flow of hot air from heated air supply 9, the correct amount of smoke fluid vapor will be drawn into delivery chamber 46 so that the ratio of hot air and smoke fluid vapor will always be correct, no matter how much smoke is required at a particular time. When an increased amount of smoke is required, the amount of hot air delivered to ejector 8 is simply increased, and that amount of hot air will, correspondingly, eject more smoke fluid vapor from chamber 1.

The temperature of the hot air is sensed by heated air thermosensor 47 (see FIG. 1) and connected to a controller (not shown) by lead line 48. The controller controls heated air supply means control 49.

The heated air supply means 9 may be any device desired, e.g. air heated by electrical heaters, steam heat, infrared heaters, etc., but is conveniently a conventional blower with electrical resistance heaters, and the speed of the blower and the power to the electrical resistance heaters are controlled via heated air supply means control 49 and lead lines 50. The thermosensor 47 determines the temperature of that heated air and operates through a control means (not shown) and heated air supply means control 49 to heat the air to the desired temperature.

The heated air, after it passes through ejector 8, is supplied to a mixing means 10 by way of the force of the blower. The mixing means 10 may be a chamber or swirling device or the like, but very suitably is simply a conduit for conveying the generated simulated smoke to the desired location. (Alternatively, for some applications, the mixing means may be the chamber itself, as explained below.) Since the desired location will be, usually, distant from the apparatus for generating the simulated smoke, adequate mixing of the heated air and the smoke fluid vapor will take place during passage through that conduit and will result in a good mixture and attendant fog.

When the heated air supply means control 49 is a variable speed control for the blower, the selected amount of heated air supplied to ejector 8 will determine the corresponding amount of smoke fluid vapor supplied to mixer 10 (the conduit), and, therefore, the amount of smoke to simulate a particular fire can be easily achieved. When the trainee has applied the correct extinguishing agent for the correct time, simply by discontinuing power to the hot air supply means 9 will automatically stop the generation of smoke, since when no heated air flows through ejector 8, no smoke fluid vapor will be ejected from chamber and, consequently, no further simulated smoke will flow through mixer 10 (the conduit). Of course, if the trainee does not apply the correct agent or does not apply the correct agent for a sufficient length of time, the amount of smoke may be likewise controlled or, if the trainee does not supply the correct agent for the correct length of time, a "flashback", indicated by a sudden further burst of smoke, can be easily achieved, almost instantaneously, by powering the blower to a high speed.

Overall control of the apparatus is achieved by a conventional controller, such as a conventional computer programmed in a conventional manner to control the flow control means 5 (pump), heater control means 7 and heated air supply means 9 so as to deliver the quantity of simulated smoke required for any particular training application. Also, by exchanging ejectors 8 (venturi ejectors), the ratio of heated air to the smoke fluid vapor passed to mixer 10 can be varied so as to produce smoke of more or less optical densities. Alternatively, a restricting device can be placed in ejector 8, in a conventional manner, or a variable restricting device may be placed therein, for controlling the amount of smoke liquid vapor fed into the heated air in mixer 10, again, for controlling the optical density of the smoke.

The control of the rising of the smoke can be achieved by the temperature of the heated air, and in cases where the smoke should rise less rapidly, the temperature of the heated air is simply decreased. On the other hand, where the smoke should rise quite rapidly, the temperature of the heated air is increased. Therefore, control, very much simulating actual fire conditions, can be achieved.

Any of the conventional smoke fluids may be used with the present apparatus, including modern butylated triaryl phosphate esters. These more modern smoke fluids have considerable advantages over older smoke fluids, such as propylene glycol, military fog oil, diesel fuel, JP8 and P&G 200, since the vapors, and hence the smoke produced therefrom, are considerably less toxic than the older fluids and have a considerably less tendency to ignite. However, butylated triaryl phosphate esters do require quite high temperatures for adequate vaporization. With older conventional apparatus for generating smoke, these higher temperature result in a considerable lag between the time heating commences for generating smoke and actual smoke generation. Thus, particularly, with the modern smoke fluids, the older apparatus are not capable of achieving quick commencement and quick discontinuance of the smoke being generated, and during start-up and shut-down, the smoke densities vary considerably, so that even both rising and falling simulated smoke results, a very undesired situation. With the present apparatus, smoke can be quickly commenced or quickly discontinued, even with the modern butylated triaryl phosphate esters and controlled densities are maintained. Nevertheless, any of the older more conventional smoke fluids may be used with the present apparatus.

In operation of the apparatus, a chamber 1, as described above, is provided, with the expanded surface, as described above. The smoke fluid is distributed at the terminus 20 and along the width 21 of the expanded surface 2 of material 20*a*, and the smoke fluid is flowed from the terminus downwardly by gravity across the expanded surface and toward the outlet wall 12 as a thin film of smoke fluid. The chamber is heated by heating means 6, which also heats the expanded surface, and is heated to a temperature, as described above, but sufficient to cause the smoke fluid in the thin film to vaporize into a smoke fluid vapor. The vapor is ejected from the chamber through the outlet 12*a* (by means of the ejector 8) into the mixer 10. Heated air is supplied at a temperature sufficient to retain the smoke fluid vapor in a lighter-than-air density as it passes through mixer 10 (a conduit). The smoke fluid vapor and the heated air are mixed in mixer 10 to produce the simulated smoke. The amount and density of the smoke produced is controlled by controlling the amount of smoke fluid distributed to the terminus of the expanded surface, the temperature of the chamber and the amount of heated air supplied to the mixer, via the ejector venturi 8, such that the desired amount and density of simulated smoke is produced.

With such control, essentially all of the smoke fluid will vaporize during passage through chamber 1. However, if desired, a drain 54 may be supplied at near outlet wall 12 to drain away any smoke fluid not actually vaporized. The chamber itself may be made of metal or ceramic or any other heat-resistant material. However, since, with operation of the apparatus, some residues of the smoke fluid will inevitably be contained in the chamber, the chamber should be made of a material which will withstand abrasive cleaning. Likewise, the inserts, when used as the expanded surface, should be capable of being cleaned, e.g. by soaking in conventional solvents, such as alcohols and mineral spirits, although, conveniently, when inserts are used, clean inserts can be placed in the chamber and used inserts simply discarded.

While the invention has been explained above in connection with, primarily, the apparatus illustrated by FIG. 1, it will be easily appreciated from the above explanation that the particular embodiment of FIG. 1 is not critical to the apparatus or process. As explained above, to achieve the rapid vaporization of the smoke fluid, it is necessary for the smoke fluid to be presented as a thin film for evaporation purposes and for successful operation of the apparatus and method, that thin film should flow by gravity. When the thin film is flowed by mechanical means or pressure means, turbulence in the thin film will inevitably occur, and instead of a thin continuous film, rivulets of film will occur, with considerable decrease in surface area of the film and slow evaporation of the smoke fluid.

However, as is also quite apparent from the above description, the chamber 1 need not be in the elongated rectangular form, as shown in FIG. 1, but can be provided in a variety of configurations, so long as those configurations provide the appropriate slope for the gravity flow of the film. For example, a plurality of chambers 1, as shown in FIG. 1, may be arranged in a "wagon wheel" fashion with a common lower terminus at the "hub" thereof. Alternatively, as shown in FIG. 9, the chamber 1 may be somewhat dish shaped and may have a plurality of inlets 11*a* spaced around inlet wall 11. Likewise, the chamber 1 may have a plurality of outlets 12*a* spaced near the outlet wall 12, as shown in FIG. 9.

Alternatively, instead of a dish-shaped chamber 1, the chamber may be arcuate shaped as shown in FIG. 10, and again, a plurality of inlets and outlets may be provided. Similarly, while not shown, the configuration of the chamber could be angular, since it is only necessary that a combination of the center lines of the surface, collectively, provide the decreasing center line for the slope to achieve gravity flow of the smoke fluid.

Also, as explained above, it is far preferable that the surface upon which the thin film of smoke fluid flows is an expanded surface, to ensure the greater surface area of the thin film for quick evaporation purposes. However, as also explained above, for some limited applications, that surface area need not be expanded but can simply be an extended surface for flow of the film. This would, of course, require a greater chamber size per volume of smoke produced, but where size, weight, and the like are not substantial factors, the extended surface can be substituted for the expanded surface. However, where an extended surface, rather than an expanded surface, is used, appropriate measures should be taken to ensure that the flow of the smoke fluid is in thin film form and will flow in that thin film form by gravity. Surface treatments, such as coatings, slight roughening, grooves, and the like, depending upon the particular smoke fluid being utilized, are acceptable for this purpose. Of course, with certain surface materials and certain smoke fluids, the surface alone may be sufficient for that purpose.

Figure 11:
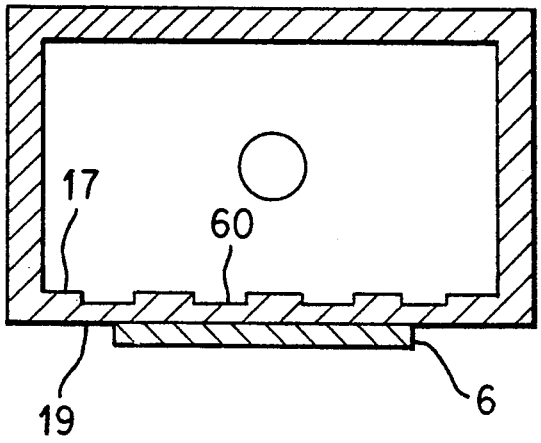
FIGS. 11 and 12 show an alternative embodiment, where
Figure 12:
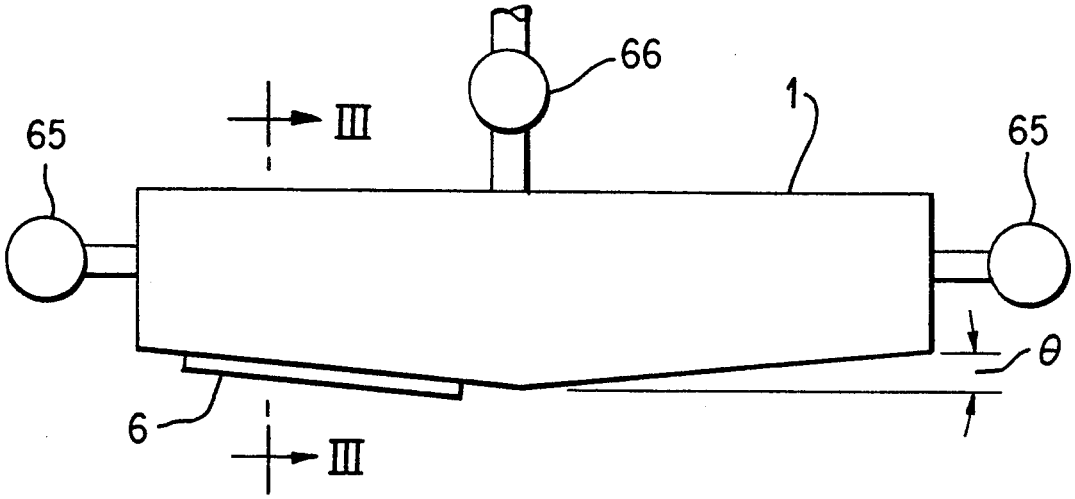

An example of the foregoing is shown in FIGS. 11 and 12. These figures relate to a specialized embodiment of the invention. In this embodiment, grooves 60 are spaced along the inside surface 17, as shown in FIG. 11. These grooves are relatively shallow, e.g. 0.01 inch to 0.2 inch, more usually between about 0.06 inch and 0.15 inch, and are from 0.1 to 2 inches wide, e.g. 0.25 inch wide. When heater 6 is on the bottom wall 19, the heat applied to bottom wall 19 will cause that bottom wall to buckle and form a slope with an overall angle Θ, as described above and as shown in FIG. 12. Inlet blowers 65 (see FIG. 12) introduce heated air into chamber 1 and outlet blowers 66 (only one being shown) pull the generated smoke from chamber 1, or vice versa. In this case, the blowers, both inlet and outlet blowers, are the ejector means and heated air means described above. Also, in this case, the chamber 1, itself, is the mixing means described above. Otherwise, this embodiment functions in the same manner as described above.

This arrangement has specialized advantages for fire-fighting trainers which are operated under positive pressure so as to ensure that combustible gases do not collect in the trainer. By use of one or more of the positive pressure blowers 65, 66, as described above, it is possible to inject the generated smoke into a positive pressure trainer, as opposed to the embodiment of FIG. 1, where the pressure generated in mixer 10 might not be sufficient to inject the generated smoke into a positive pressure trainer, especially one of relatively high positive pressure. Also, with this arrangement, a plurality of outlet blowers may be turned on and off to direct smoke to different rooms or parts of rooms in a positive pressure trainer.

The grooved bottom wall which will buckle, on heating, to provide the slope has the advantage that, when cool, no slope is assumed by the bottom wall and the thin film flow of smoke fluid ceases. Of course, the grooves 60 must be arranged such that the grooves allow buckling of the bottom wall when the bottom wall has been heated to a temperature near the vaporization temperature of the particular smoke fluid being used.

Also, with this arrangement, often no expanded surface is necessary for some applications, since the grooves constitute some expansion of the surface area of bottom wall 19 and then is often sufficient to generate adequate vaporized smoke fluid.

Of course, with the embodiment of FIGS. 11 and 12, multiple smoke fluid inlets, i.e. at least one at each end, will be required, similar to that shown in FIG. 9. Also, the multiple vaporized smoke fluid outlets can be connected together, and only one outlet blower may be used to introduce the smoke into a positive pressure trainer.

Having described the invention, it will be quite apparent to those skilled in the art, that many modifications of the above detailed description will be apparent, and it is intended that those modifications be embraced by the spirit and scope of the annexed claims.

What is claimed is:

1. An apparatus for controllably generating simulated smoke from a simulated smoke-generating fluid, comprising:

(a) a vaporizing chamber having an inlet, an outlet and walls extending between said inlet and outlet so as to substantially enclose said chamber, said chamber having a center line between an inlet wall and an outlet wall such that the center line is declined from the horizontal from the inlet wall to the outlet wall;

(b) a surface disposed on and substantially co-extensive with a major portion of inside surfaces of lowermost portions of said walls and terminating at an end thereof near said inlet in a terminus of defined width;

(c) smoke fluid distribution means for distributing smoke fluid along said terminus and said width so that the smoke fluid is flowable by gravity from said terminus, downwardly across said surface, and toward said outlet, as a thin film of the smoke fluid;

(d) smoke fluid supply means for containing smoke fluid;

(e) conduit means communicating with said supply means and said distribution means for flowing smoke fluid from said supply means to said distribution means;

(f) flow control means for controlling the flow of smoke fluid to said distribution means;

(g) heating means and heating control means for controllably heating said chamber and said surface to a temperature sufficient to cause the smoke fluid in the said thin film to vaporize to a smoke fluid vapor;

(h) ejector means for ejecting said smoke fluid vapor out of said chamber through said outlet;

(i) heated air supply means for supplying air heated to a temperature sufficient to retain the smoke fluid vapor lighter than air;

(j) mixing means communicating with said ejector and said heated air supply means for mixing said smoke fluid vapor and said heated air; and (k) heated air control means for controlling the flow of heated air to said mixing means.

2. The apparatus of claim 1 wherein the walls define a chamber cross section which is substantially the same as an annular space between said walls.

3. The apparatus of claim 1 wherein said center line extends between said inlet and said outlet.

4. The apparatus of claim 3 wherein said center line is straight.

5. The apparatus of claim 1 wherein the center line is declined from the horizontal in an amount of between 5° and 30°.

6. The apparatus of claim 5 wherein said amount is between 10° and 20°.

7. The apparatus of claim 1 wherein the surface is an expanded surface which has an expanded surface area per unit which is greater than the surface area per same unit as the inside surfaces.

8. The apparatus of claim 7 wherein the expanded surface is a roughened portion of said inside surfaces.

9. The apparatus of claim 7 wherein said expanded surface is an insert disposed on said inside surfaces and the expanded surface is at least twice the surface area per unit as the inside surfaces.

10. The apparatus of claim 9 wherein the insert is comprised of expanded sheets.

11. The apparatus of claim 9 wherein the insert is comprised of expanded mesh.

12. The apparatus of claim 9 wherein the insert is comprised of distillation packings.

13. The apparatus of claim 1 wherein said distribution means comprises an elongated passageway having a plurality of orifices therein disposed along said terminus.

14. The apparatus of claim 1 wherein said flow control means is a pump.

15. The apparatus of claim 14 wherein the pump is a variable flow pump.

16. The apparatus of claim wherein the heating means are electric heaters disposed along outside surfaces of outer walls of said chamber.

17. The apparatus of claim 16 wherein the heating control means is a thermosensor for sensing the temperature in said chamber and applying or discontinuing electric current to said electric heaters.

18. The apparatus of claim 1 wherein the ejector means is a venturi ejector or a blower.

19. The apparatus of claim 1 wherein the heated air is supplied by a hot air blower.

20. The apparatus of claim 18 wherein the ejector means is an ejector venturi and the heated air supplied is supplied by a hot air blower which blows heated air outside of the venturi and causes ejection of the smoke liquid vapor through the venturi.

21. The apparatus of claim 1 wherein the mixing means is the chamber itself or a conduit for conveying the generated simulated smoke to a desired location.

22. The apparatus of claim 19 wherein the heated air control means is a variable speed control for said blower.

23. The apparatus of claim 22 wherein the smoke liquid is a butylated triaryl phosphate ester.

24. A method for controllably generating simulated smoke from a simulated smoke-generating fluid, comprising:

(a) providing a vaporizing chamber having an inlet, an outlet and walls extending between said inlet and outlet so as to substantially enclose said chamber, said chamber having a center line between an inlet wall and an outlet wall such that the center line is declined from the horizontal from the inlet wall to the outlet wall;

(b) providing a surface disposed on and substantially co-extensive with a major portion of inside surfaces of lowermost portions of said walls and terminating at an end thereof near said inlet in a terminus of defined width;

(c) distributing smoke fluid along said terminus and flowing the smoke fluid from said terminus downwardly by gravity across said surface and toward said outlet as a thin film of the smoke fluid;

(d) controllably heating said chamber and said surface to a temperature sufficient to cause the smoke fluid in the said thin film to vaporize to a smoke fluid vapor;

(e) ejecting said smoke fluid vapor out of said chamber through said outlet and into a mixer;

(f) supplying air heated to a temperature sufficient to retain the smoke fluid vapor lighter than air;

(g) mixing said smoke fluid vapor and said heated air; and (h) controlling the amount of smoke fluid distributed to said terminus, the temperature of said chamber and the amount of heated air so as to produce an amount and density of simulated smoke as desired.

25. The method of claim 24 wherein the walls define a chamber cross section which is substantially the same as an annular space between said walls.

26. The method of claim 24 wherein said center line extends between said inlet wall and said outlet wall.

27. The method of claim 26 wherein said center line is straight.

28. The method of claim 24 wherein the center line is declined from the horizontal in an amount of between 5° and 30°.

29. The method of claim 28 wherein said amount is between 10° and 20°.

30. The method of claim 24 wherein the surface is an expanded surface which has an expanded surface area per unit which is greater than the surface area per same unit as the inside surfaces.

31. The method of claim 30 wherein the expanded surface is a roughened portion of said inside surfaces.

32. The method of claim 30 wherein said expanded surface is an insert disposed on said inside surfaces and the expanded surface is at least twice the surface area per unit as the inside surfaces.

33. The method of claim 32 wherein the insert is comprised of expanded sheets.

34. The method of claim 32 wherein the insert is comprised of expanded mesh.

35. The method of claim 32 wherein the insert is comprised of distillation packings.

36. The method of claim 24 wherein said distribution means comprises an elongated passageway having a plurality of orifices therein disposed along said terminus.

37. The method of claim 24 wherein the smoke fluid is pumped to a means for distributing the smoke fluid.

38. The method of claim 37 wherein the pump is a variable flow pump.

39. The method of claim 24 wherein the electric hearers are disposed along outside surfaces of outer walls of said chamber and heat said chamber.

40. The method of claim 39 wherein a thermosensor senses the temperature in the chamber and applies or discontinues electric current to the electric heaters.

41. The method of claim 24 wherein the smoke vapor is ejected through a blower or a venturi ejector.

42. The method of claim 24 wherein the heated air is supplied by blowing with a hot air blower.

43. The method of claim 41 wherein the vapor is ejected by an ejector venturi and the heated air is supplied by blowing with a hot air blower which blows heated air through the venturi and causes ejection of the smoke liquid vapor through the venturi.

44. The method of claim 24 wherein the mixer means is the chamber itself or a conduit for conveying the generated simulated smoke to a desired location.

45. The method of claim 42 wherein the heated air is controlled by a variable speed control for said blower.

46. The method of claim 24 wherein the smoke liquid is a hydrocarbon or substituted hydrocarbon.

47. The method of claim 46 wherein the smoke liquid is a butylated triaryl phosphate ester.

* * * * *